US005149150A

United States Patent [19]

Davis

[11] Patent Number: 5,149,150

[45] Date of Patent: Sep. 22, 1992

[54] MOTION TRANSMITTING AND AMPLIFYING DEVICE

[75] Inventor: Allen V. C. Davis, Chatsworth, Calif.

[73] Assignees: Kathryn L. Acuff Trust; Heather Ruth Davis Trust, both of Chatsworth, Calif.

[21] Appl. No.: 679,156

[22] Filed: Mar. 26, 1991

Related U.S. Application Data

[60] Continuation-in-part of Ser. No. 444,450, Dec. 21, 1989, abandoned, which is a division of Ser. No. 284,947, Dec. 14, 1988, Pat. No. 4,891,479.

[51] Int. Cl.[5] ..... H01H 35/34

[52] U.S. Cl. ..... 267/159; 74/100.2; 267/161; 267/164; 200/83 R

[58] Field of Search ..... 267/159–165; 200/83 R, 83 P; 337/318; 74/100 P

[56] References Cited

U.S. PATENT DOCUMENTS

| | | | |
|---|---|---|---|
| 2,476,045 | 1/1942 | Kaminky | 74/100 |
| 2,516,236 | 7/1950 | Moorhead et al. | 267/159 |
| 2,624,819 | 1/1953 | Spina et al. | 267/159 |
| 2,703,231 | 3/1955 | Ryde | 267/159 |
| 3,173,306 | 3/1965 | Hoag | 267/163 |
| 3,178,529 | 4/1965 | McCarrick | 74/100 |
| 3,671,997 | 6/1972 | Sigmund | 267/164 |
| 4,601,376 | 7/1986 | Reik | 267/161 |
| 4,623,991 | 11/1986 | Vitringa | 267/161 X |
| 4,891,479 | 1/1990 | Davis | 200/83 P |

*Primary Examiner*—Matthew C. Graham
*Attorney, Agent, or Firm*—Wagner & Middlebrook

[57] ABSTRACT

A resilient element such as a thin flat plate or disc spring, commonly known as a "Belleville" spring, which is capable of deflecting along an axis normal to its surface is modified to include an amplifying segment disposed in a central aperture in the form of an approximately "W" shaped strip connected at its ends to opposite positions on the inner margin of the central opening. The central portion of the "W" forms an inverted "U" which is subjected, after positioning within the central aperture, to torquing stress in the plane of the material to bring the ends of the open end of the "U" slightly closer together than the inner edges of the "U" nearest its closed end. One of a pair of switch contacts is mounted on the closed end of the "U" shaped portion of the device opposite another contact carried on the switch bases. Means are provided for applying pressure, normal to the plane of the material, on some position of the peripheral sensing spring in which the ends of the "W" shaped portion connect with the inner margin of the central opening of said sensing spring and when such pressure rises to a predetermined level, the "U" shaped portion will snap over to a position in which the contact which it carries will assume an opposite portion with respect to the contact carried by the switch frame.

13 Claims, 5 Drawing Sheets

FIG. 8
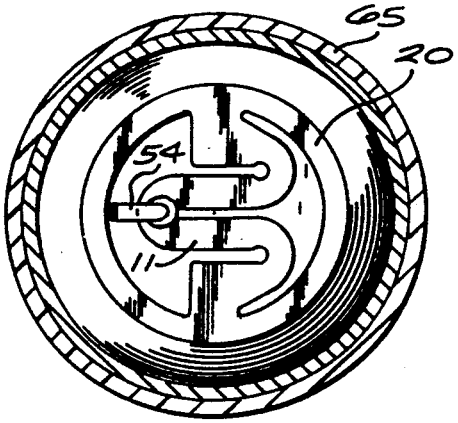
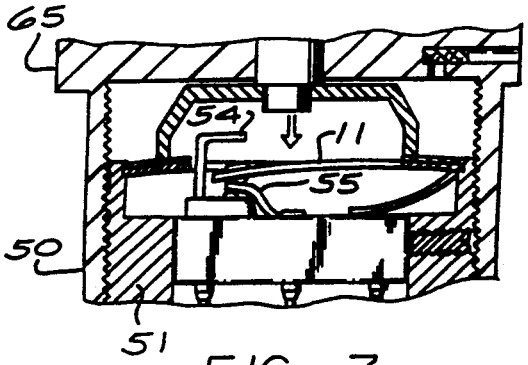
FIG. 7
FIG. 3
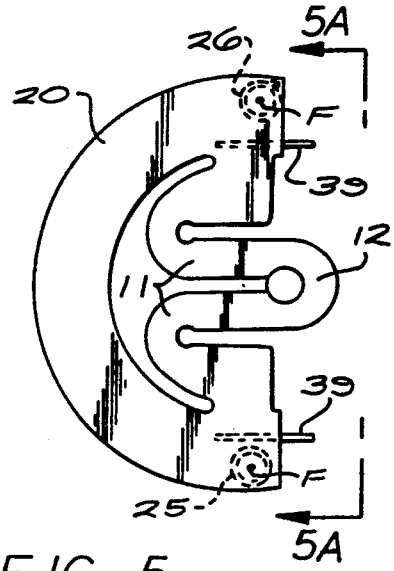
FIG. 5
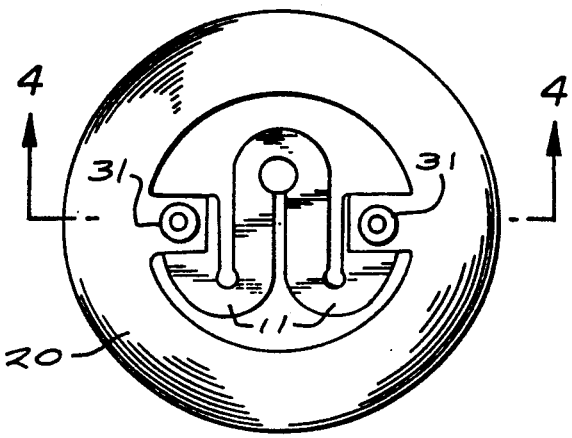
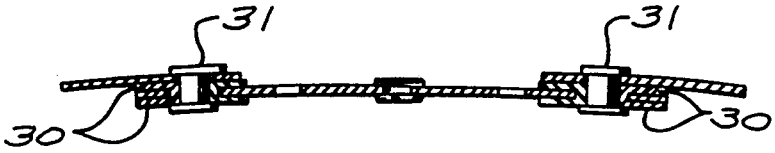
FIG. 4

FIG. 5A
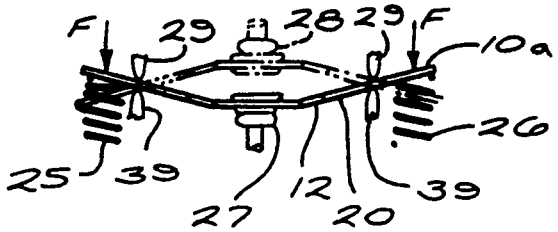
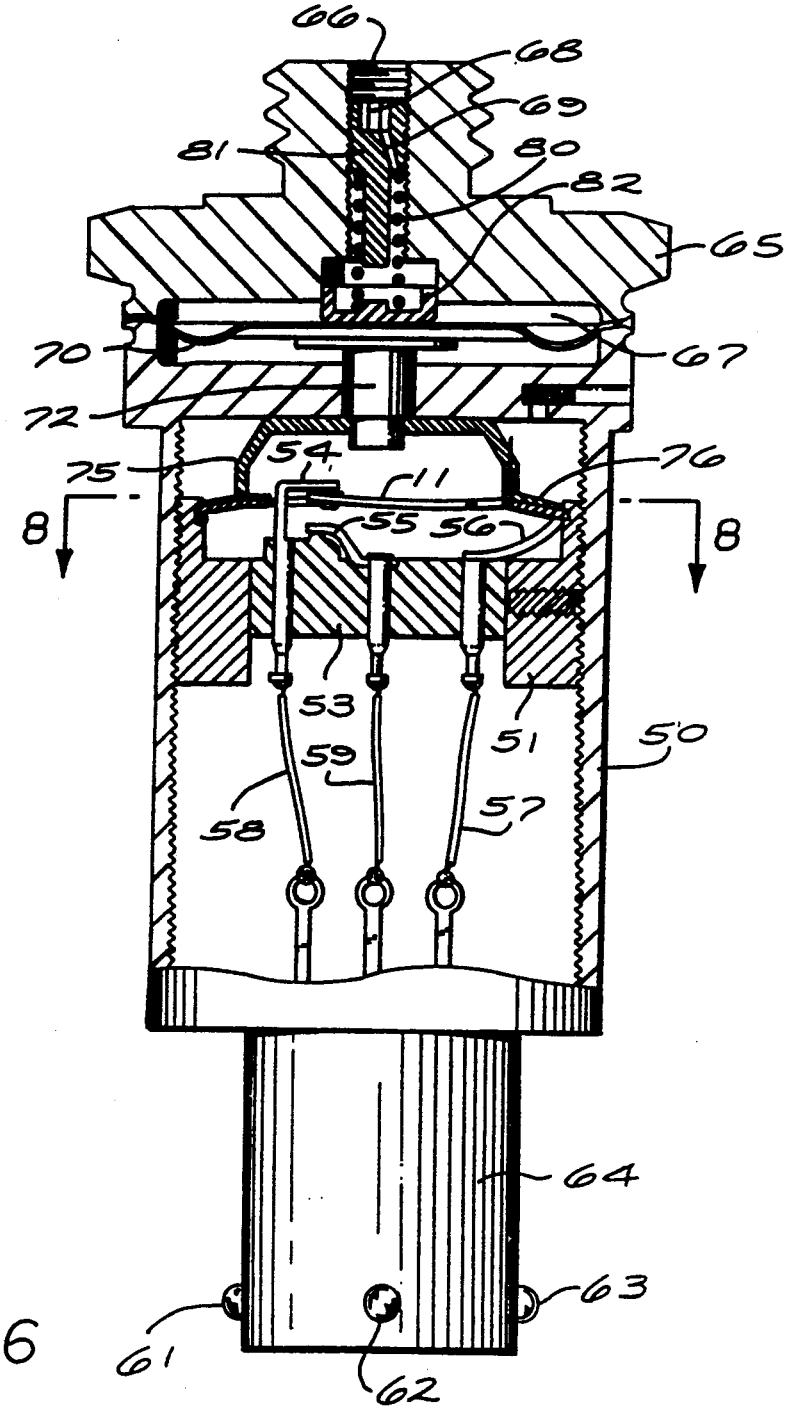
FIG. 6

FIG. 9
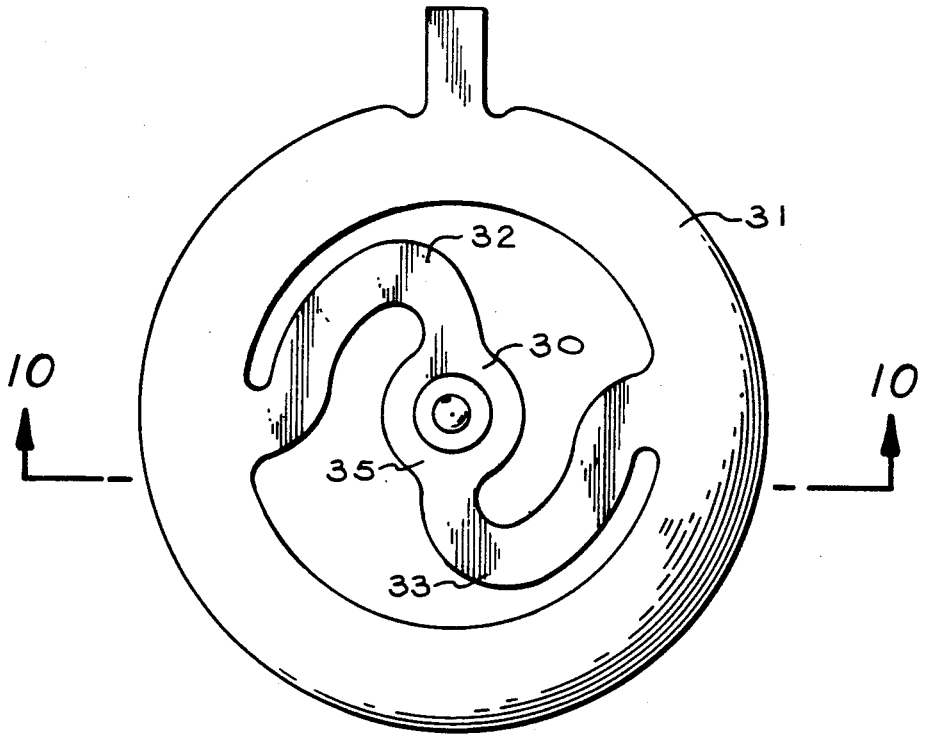
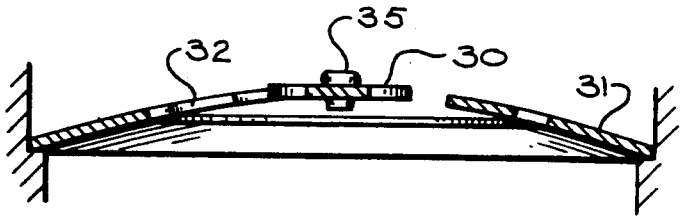
FIG. 10A
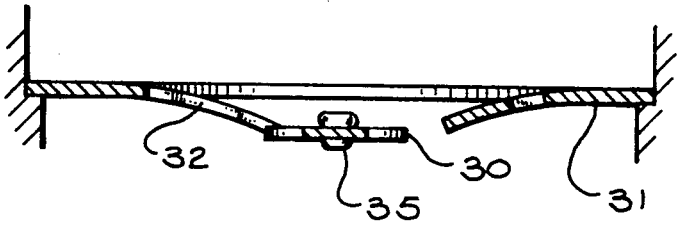
FIG. 10B

FIG. 11
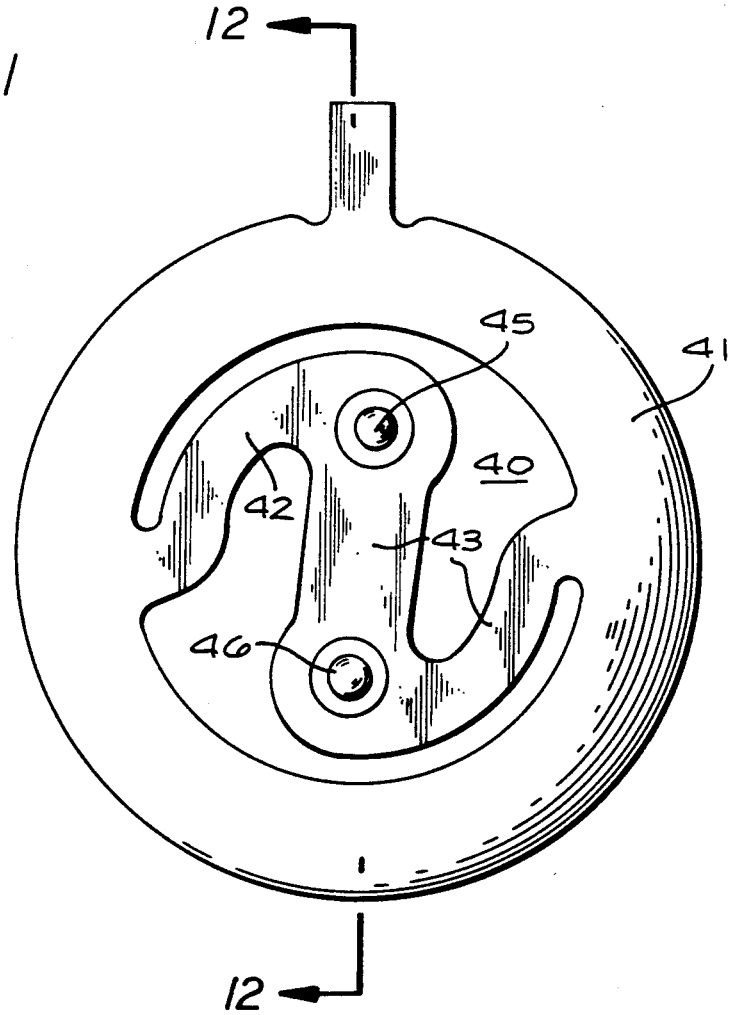
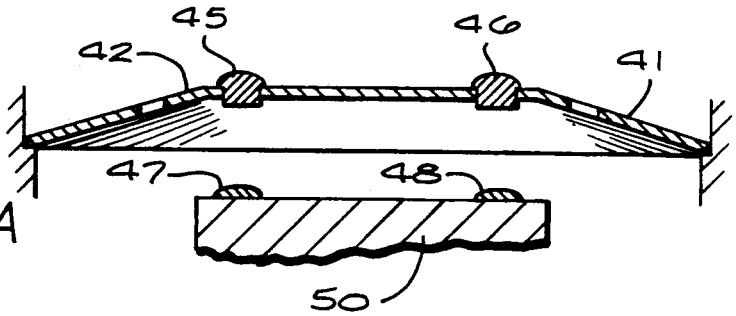
FIG. 12A
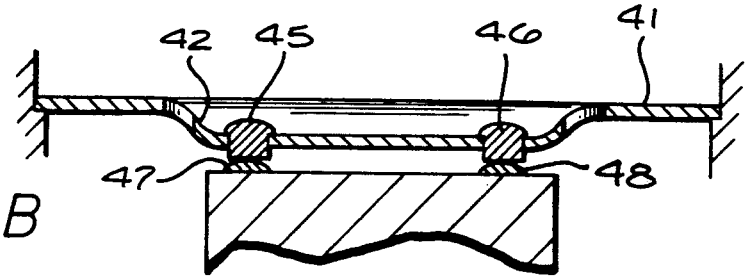
FIG. 12B

MOTION TRANSMITTING AND AMPLIFYING DEVICE

This is a continuation-in-part of copending application(s) Ser. No. 07/444,450 filed on Dec. 21, 1989 now abandoned, which is a divisional of application Ser. No. 284,947 filed Dec. 14, 1988 now U.S. Pat. No. 4,891,479.

BACKGROUND OF THE INVENTION

1. Field of the Invention

The present invention relates to improvements in snap action devices for transmission and amplification of control movements. Such devices are especially useful in electrical switches and analogous devices in which a small sensing movement such as that of a temperature or pressure sensor is to be translated into a larger, and usually snap action, movement of an electrical contact or analogous element.

2. Description of the Prior Art

Devices for the transmission and amplification of snap action movement are disclosed in the British patent of Grey No. 405,441 and the Proctor U.S. Pat. No. 2,200,995 both of which utilize levers, pivots and secondary springs to amplify movements and produce snap action in an opening and closing electrical contacts. While this type of structure is still widely in use, it is subject to drifting of the actuation points due to its mechanical complexity. Simplification of this type of device is disclosed in the Davis U.S. Pat. Nos. 2,824,919 and 3,472,980 wherein a simple disc spring both senses the actuation pressure and provides a snap deflection movement to actuate a device utilizing lever amplification to operate electrical contacts.

It is a primary object of the present invention to provide, in an integral unit, a device for effecting amplification sufficient to directly perform a secondary function, such as opening and closing electrical contacts, valve poppets or analogous devices, by means of a unitary structure which accomplishes the sensing function and simultaneously effects the amplification and deflection without the use of pivoted levers or secondary springs.

SUMMARY OF THE INVENTION

According to the present invention, a resilient element such as a thin flat plate or disc spring, commonly known as a "Belleville" spring, which is capable of deflection along an axis normal to its surface is modified to include an amplifying segment disposed in a central aperture in the form of an approximately "W" shaped strip connected at its ends to opposite positions on the inner margin of the central opening. The central portion of the "W" forms an inverted "U" which is subjected, after positioning within the central aperture, to torquing stress in the plane of the material to bring the ends of the open end of the "U" slightly closer together than the inner edges of the "U" nearest its closed end.

According to the present invention, it has been discovered that a small rotational displacement normal to the plane of the material of the ends of the "W" connected to the margin of the central opening will result in a snap deflection of considerable magnitude at the closed end of the "U" shaped portion in a direction normal to that plane. A slight displacement of the "W" also occurs if the device is supported at its outer periphery.

In applying this device to the operation of an electrical switch, one of a pair of contacts is mounted on the closed end of the "U" shaped portion of the device opposite another contact carried on the switch base. Means are provided for applying pressure, normal to the plane of the material, on some position of the peripheral sensing spring in which the ends of the "W" shaped portion connect with the inner margin of the central opening of said sensing spring and when such pressure rises to a predetermined level, the "U" shaped portion will snap over to a position in which the contact which it carries will assume an opposite portion with respect to the contact carried by the switch frame.

DESCRIPTION OF THE DRAWINGS

FIG. 3 is a view in plan of a modified form of the motion transmitting and amplifying device of the present invention.

FIG. 4 is a view in section of the device of FIG. 3 taken on the line 4—4 of FIG. 3.

FIG. 5 is a view in plan of a second modified embodiment of a motion transmitting and amplifying device embodying the present invention.

FIG. 5A is a fragmentary view in side elevation of an assembly employing a modification employing a device made from a flat sheet and employing separate restoration springs.

FIG. 6 is a sectional view in side elevation of a pressure sensitive switch embodying the motion transmitting and amplifying device of the present invention.

FIG. 7 is a fragmentary sectional view in side elevation of the switch of FIG. 6 showing the actuate position of the motion transmitting and amplifying device.

FIG. 8 is a view in horizontal section of the switch of FIG. 6 taken on the line 8—8 of FIG. 6.

FIG. 9 is a view in plan of a third embodiment of the present invention.

FIGS. 10A and 10B are view in section, taken on the line 10—10 of FIG. 9, illustrating the two positions which the central portion of the device may assume in operation.

FIG. 11 is a view in plan of a fourth embodiment of the present invention.

FIGS. 12A and 12B are view in section, taken on the line 12—12 of FIG. 11, illustrating the two positions which the central portion of the device may assume in operation.

DESCRIPTION OF THE PREFERRED EMBODIMENTS

Figure 1:
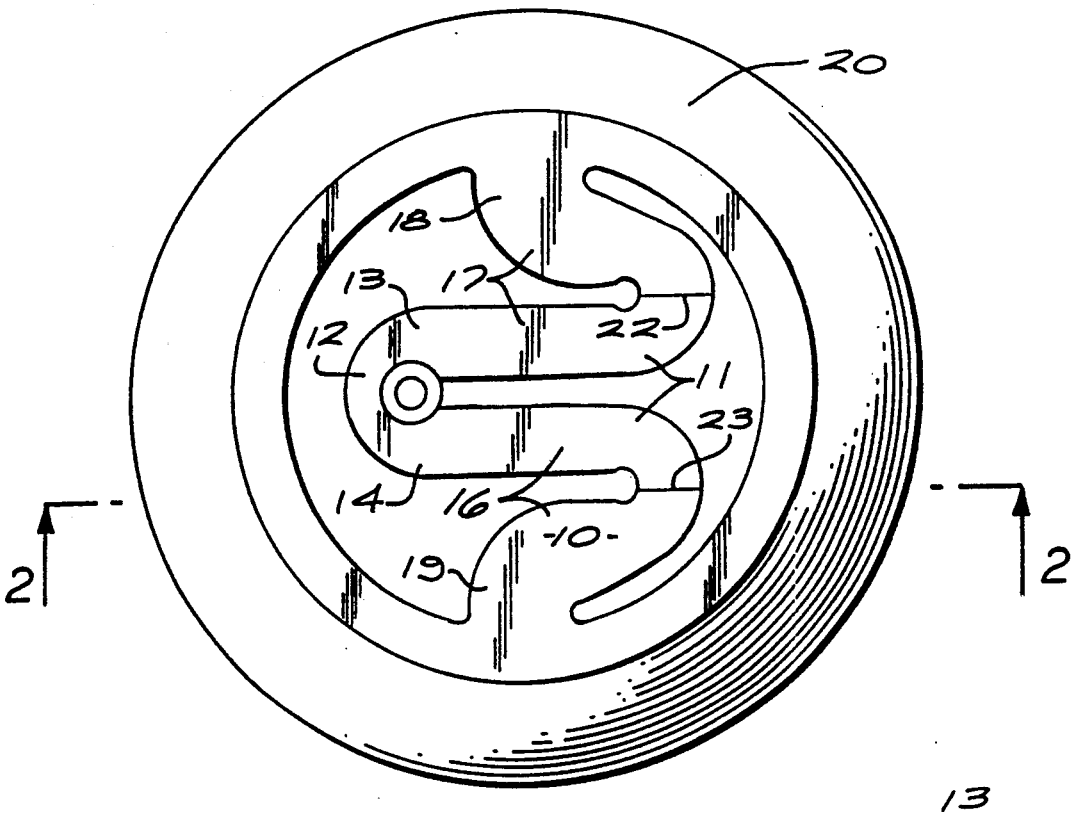
FIG. 1 is a view in plan of a motion transmitting and amplifying device embodying the present invention.

As shown in the accompanying drawings, one form of the motion transmitting and amplifying device of the present invention comprises thin strip 10 of spring metal the shape of which approximates that of the letter "W" which includes a central output loop 11 in the shape of an inverted letter "U", having a closed free end 12 and generally parallel legs 13 and 14. Each of the legs 13 and 14 is integrally connected at one end thereof to one of a pair of driver loops 16 and 17 each of which has an oppositely extending end 18 and 19.

Means are provided for constraining the oppositely extending ends 18 and 19 of driver loops 16 and 17 against outward movement with respect to each other. This means comprises a frustum 20 of thin spring metal functionally integral with the ends 18 and 19, respectively, of driver loops 16 and 17. Frustum 20 together with the U shaped output loop 11, driver loops 16 and 17 and U member may conveniently be fabricated as a stamping from a conventional disc or "Belleville" spring.

Figure 1A:
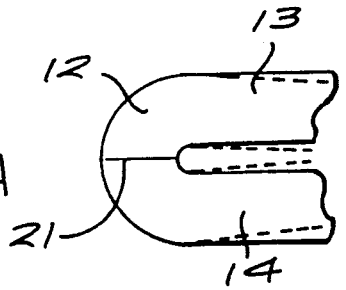
FIG. 1A is a fragmentary view of a portion of the central output loop showing its stressed configuration in dotted lines.

After completion of the fabrication of the assembly just described, the legs 13 and 14 of the output loop 11 are stressed so as to bring the ends of the legs connected to the driver loops 16 and 17 closer together as shown in dotted lines in FIG. 1A, than the opposite ends of those legs. This may be accomplished either by increasing the spacing between the legs at the closed end 12 of the loop 11, as by peening the metal along the line 21, by decreasing the spacing between the legs at the open end of loop 11, as by peening the metal of one or both of the driver loops 16, 17 along the lines 22, 23 or otherwise widening one or more of the loops 11, 16 and 17.

Figure 2A:
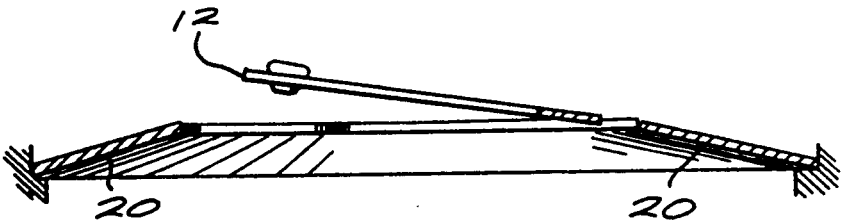
FIGS. 2*a* and 2*b* are views in section of the device of FIG. 1 illustrating the two positions which the "U" shaped portion may assume in operation.
Figure 2B:
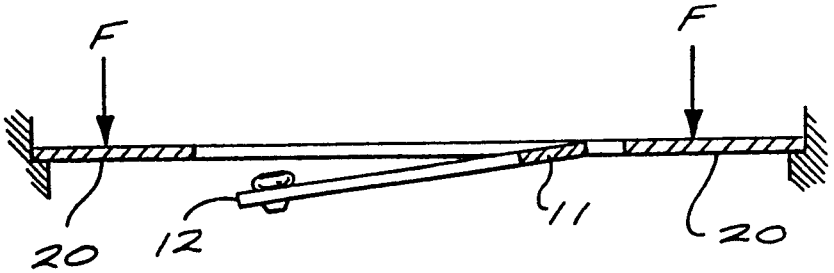

The movement transmitting and amplifying device of the present invention fabricated as described above initially has the configuration shown in section in FIG. 2*a*, but when pressure of a predetermined magnitude is applied to some portion of the upper surface of the frustum 20, for example, adjacent its connection with the driver loops 16, 17, the device will assume the configuration shown in FIG. 2*b*; the magnitude of movement of the free end 12 of output loop 11 being approximately ten times that of the portion of the device to which pressure was applied. Upon release of the pressure applied to the upper surface of the frustum 20, the resilience of the frustum will cause restoration of the device to the configuration shown in FIG. 2*a*.

If, however, a flat sheet of spring metal is substituted for a disc spring in fabricating the device of the present invention as described above, the device will operate in the same way except that it will not restore to its original configuration upon release of the activating pressure. Restoration of a device so constructed responsive to actuation forces F applied to the embodiment of FIGS. 5 and 5A must be accomplished by pressure applied in a direction opposite to the activating pressure.

An example of such return force applying means is illustrated structurally in FIG. 5 and operationally as return springs 25 and 26 in FIG. 5A. In this modification of the device of the present invention, the outer edge of a flat sheet of spring metal 10*a* configuration as shown in FIG. 5, is urged into the position shown in FIG. 5A by compression springs 25 and 26 engaging opposite points on its periphery. The spring metal 20 is supported at two discrete points or a full or partial annular fulcrum intermediate its edge and the "W" portion of opposite fulcrum members 29 and 39.

In this position, the free end 12 of its output loop engages an electrical contact 27 carried by the base. However, when downward pressure overcomes springs 25 and 26, the device snaps over to the position shown in dotted lines in FIG. 5A, so that the free end 12 engages a contact 28.

Also, if the frustum 21 is segmented as shown in FIG. 5, the output loop 11 will not automatically restore to the position shown in FIG. 2*a* upon release of pressure applied to the frustum 20, but will remain in position shown in FIG. 2*b* until pressure is applied to the opposite side of the frustum 20. Alternatively, the segment may be supported by opposing springs means such as the springs 25 and 26 of FIG. 5A to effect restoration to its former position and provide an elastic load resisting element.

It is not necessary that the strip 10 be formed integrally with the frustum 20, as shown in FIGS. 1, 2*a*, 2*b* and 5, but only that they be connected as shown in FIGS. 3 and 4 as by strips 30 of dielectric material embracing the ends of the strip 10 and the inner edge of the central opening of frustum 20 and connected together by rivets 31.

The bowed, longitudinally extending, sinuous trip of spring metal constituting the central portion of the device of the present invention may, alternatively, take the approximate form of the letter "S". As shown in FIGS. 9, 10A and 10B, the device in this form comprising a central output portion 30 extending generally diametrically of a circular frustum 31 of thin spring metal to which it is connected by driver loops 32 and 33 so that the frustum constrains the outer ends of the driver loops against outward movement with respect to each other.

This form of the device of the present invention initially assumes the configuration illustrated in FIG. 10A but, upon the application of pressure of predetermined magnitude to the upper surface of frustum 31, will evert to the configuration shown in FIG. 10B; the axial movement of the central point 35 of the central output portion 30 being approximately three or more times that of the inner rim of the frustum 31.

The device of the present invention, in the form is which the central portion has the "S" shape may, as shown in FIGS. 11, 12A and 12B, carry a plurality of electrical contacts in conducting relationship. In this form, the device comprises 3 central output portion 40 extending generally diametrically of a circular frustum 41 of this spring metal to which it is connected by driver loops 42 and 43 so that the frustum constrains the outer ends of the driver loops against outward movement with respect to each other. Electrical contacts 45 and 46 electrically connected together by the metal of the central output portion 40, functioning as a shorting bar, may be employed to close a circuit between two insulated contacts such as 47 and 48 (FIGS. 12A and 12B) mounted on the frame of z switch, when the central portion 40 is in one of the two positions shown in FIGS. 12A and 12B, and to open such 3 circuit when the portion 40 is in the other of those positions.

The operation of this form of the device otherwise corresponds to that of the device of FIGS. 9, 10A and 10B.

While the motion transmitting and amplifying device of the present invention is useful in any of a wide variety of environments in which a small sensed displacement is required to produce a control signal as by opening or closing an electrical circuit or valving a pneumatic control, FIGS. 6, 7 and 8 of the accompanying drawings show it as embodied in a pneumatic sensing electrical switch.

As shown in FIG. 6, the switch comprises a cylindrical internally threaded casing 50 into which there is threaded a cylindrical switch base 51 carrying adjacent its upper end a motion transmitting and amplifying device of the construction shown in FIGS. 1–4, 5 or 5A the outer edge of which is seated on a wire loop 52 retained in the base 51. A block of insulating material 53 carried by the base 51 supports an upper contact 54 which projects through the central opening of the frustum 20 and overlies the free end of the output loop 11.

Also supported by the block 53 is a lower contact 55 which underlies the free end of the output loop 11 and, as shown in FIG. 7, is engageable thereby in the displaced position of the output loop 11. The wire loop 52 terminates in a conductor 56 which is electrically connected to a lead 57. Separate conductors 57, 58, and 59 provide electrical connections between contacts 54 and 55 and exterior contacts 61, 62 and 63 carried by an extension 64 of casing 50.

Means are provided for causing the output loop 11 to move from the position in which it is shown in FIG. 6 to the position in which it is shown in FIG. 7. This means comprises a cap 65 secured as by welding to the upper end of the casing 50 and provided with a port 66 through which fluid under pressure may be admitted to a cavity 67 in the cap 65 via passages 68 and 69. A diaphragm 70 divides the cavity 67 into upper and lower portions, and contained in the lower portion is a pressure plate 71 engaging the underside of the diaphragm 70.

Centrally connected to the pressure plate 71 and slideably mounted in the lower portion of the cap 65 is an actuator 72 which carries at its lower end a cup shaped register 75 the free lower edges of which engage a washer 76 of insulating material overlying frustum 20 to electrically insulate it from the register 75.

Downward pressure is exerted on a diaphragm 70 and pressure plate 71 by a spring 80 the compression of which is adjustable by means of a hollow pin 81 threaded into the port 66 and exerting pressure against a cup 82 bearing on the diaphragm 70 centrally of the pressure plate 71.

In operation, the pressure exerted by the spring 80 may be adjusted up to the point of almost overcoming the resistance of the frustum 20 in the position in which it is shown in FIG. 6. This provides a range of adjustment of pneumatic pressures needed to be introduced through the port 66 to be sufficient to depress the diaphragm 70 and pressure plate 71 causing the output loop 11 to move from engagement with the upper contact 54 and into engagement with the lower contact 55.

It is to be understood that the present invention is not limited to the details of the illustrative embodiments particularly described herein, but that various modifications may be made without departing from the invention as defined in the claims.

I claim:

1. A motion transmitting and amplifying device for effecting electrical contact responsive to a deforming force applied to one surface thereof comprising;

a spring metal disc having a substantially continuous circular rim portion and a central motion translating and amplifying portion;

said central motion translating and amplifying portion configured to resemble the letter W including a pair of driver loops having generally parallel legs and an output loop having generally parallel legs;

one leg of each of said driver loops being connected to a different leg of said output loop;

electrical contact means on said output loop;

and means connecting the ends of said driver loops opposite their connections with said output loop confining the outer ends of said driver loops against outward movement with respect to each other;

said connecting means comprising the substantially continuous circular rim portion;

the legs of said output loop being locally stressed by deformation so that the legs of said output loop are closer together at their connection with said driver loops than at the closed end of said output loop;

whereby deforming force applied to one face of said disc produces amplified movement of said contact on said output loop in the same direction as the applied force.

2. A motion transmitting and amplifying device according to claim 1 fabricated from a single sheet of spring metal.

3. A motion transmitting and amplifying device according to claim 1 fabricated from a disc spring.

4. A motion transmitting and amplifying device according to claim 1 in which said driver loops are electrically insulated from the means connecting the ends thereof.

5. A motion transmitting and amplifying device according to claim 1 in which the means connecting the ends of said driver loops encircles both the driver loops and the output loop.

6. A motion transmitting and amplifying device according to claim 1 in which the means connecting the ends of the driver loops partially encircles the driver loops and the output loop.

7. A motion transmitting and amplifying device for effecting electrical contact therewith responsive to deforming force applied to one surface thereof comprising;

a thin convex disc of spring metal having a continuous rim section and including an integral central section, shaped, in the absence of deforming force, as a portion of the convex disk; and said integral central section constituting a sinuous trip of spring metal connected at its ends with opposite portions of said spring metal continuous circular rims section;

said sinuous strip having a central portion disposed generally centrally of said spring metal rim section;

electrical contact means on said sinuous strip of spring metal;

said device being responsive to a given displacement of the surface of said rim portion of said spring metal section to effect a greater displacement of said central portion of said strip and to produce amplified movement of said contact in the same direction as the displacement of the spring metal rim section.

8. A motion transmitting and amplifying device according to claim 7 in which said thin section of spring metal is in the form of a full circle.

9. A motion transmitting and amplifying device according to claim 8 in which said sinuous strip of spring metal is configured to resemble the letter W.

10. A motion transmitting and amplifying device according to claim 8 in which said sinuous strip of spring metal is configured to resemble the letter S.

11. A motion transmitting and amplifying device according to claim 7 in which said thin section of spring metal is in the form of less than a full circle.

12. A motion transmitting and amplifying device according to claim 11 in which said sinuous strip of spring metal is configured to resemble the letter W.

13. A motion transmitting and amplifying device according to claim 11 in which said sinuous strip of spring metal is configured to resemble the letter S.

* * * * *